US009380674B2

(12) United States Patent
Maiwald

(10) Patent No.: US 9,380,674 B2
(45) Date of Patent: Jun. 28, 2016

(54) ELECTRONIC BALLAST FOR OPERATING AT LEAST ONE FIRST CASCADE OF LEDS AND ONE SECOND CASCADE OF LEDS

(71) Applicant: OSRAM GmbH, Munich (DE)

(72) Inventor: Hubert Maiwald, Neutraubling (DE)

(73) Assignee: OSRAM GmbH, Munich (DE)

( * ) Notice: Subject to any disclaimer, the term of this patent is extended or adjusted under 35 U.S.C. 154(b) by 140 days.

(21) Appl. No.: 14/017,402

(22) Filed: Sep. 4, 2013

(65) Prior Publication Data

US 2014/0070704 A1 Mar. 13, 2014

(30) Foreign Application Priority Data

Sep. 7, 2012 (DE) ..... 10 2012 215 933

(51) Int. Cl.
*H05B 37/00* (2006.01)
*H05B 33/08* (2006.01)

(52) U.S. Cl.
CPC ..... *H05B 33/089* (2013.01); *H05B 33/083* (2013.01); *H05B 33/0815* (2013.01); *H05B 33/0821* (2013.01); *H05B 33/0851* (2013.01)

(58) Field of Classification Search
None
See application file for complete search history.

(56) References Cited

U.S. PATENT DOCUMENTS

| | | | | |
|---|---|---|---|---|
| 7,902,771 | B2 * | 3/2011 | Shteynberg et al. | 315/307 |
| 8,564,155 | B2 * | 10/2013 | Wibben | 307/31 |
| 8,760,063 | B2 * | 6/2014 | Zhao | 315/188 |
| 8,786,194 | B2 * | 7/2014 | Shin | 315/122 |
| 8,963,431 | B2 * | 2/2015 | van den Berg et al. | 315/122 |
| 2010/0060175 | A1 | 3/2010 | Lethellier | |
| 2010/0134018 | A1 * | 6/2010 | Tziony et al. | 315/122 |
| 2010/0308738 | A1 | 12/2010 | Shteynberg et al. | |
| 2011/0273102 | A1 * | 11/2011 | van de Ven et al. | 315/193 |
| 2012/0229030 | A1 * | 9/2012 | Moskowitz et al. | 315/122 |
| 2013/0099683 | A1 * | 4/2013 | Sakuragi et al. | 315/185 R |
| 2014/0042925 | A1 * | 2/2014 | Wang | 315/232 |
| 2014/0361691 | A1 * | 12/2014 | Nederbragt et al. | 315/122 |
| 2014/0361696 | A1 * | 12/2014 | Siessegger et al. | 315/186 |
| 2015/0108909 | A1 * | 4/2015 | Rupp | 315/188 |

* cited by examiner

*Primary Examiner* — Tuan T Lam
(74) *Attorney, Agent, or Firm* — Viering, Jentschura & Partner mbB

(57) ABSTRACT

An electronic ballast may include: a rectifier; a first unit including a first cascade of LEDs and a first storage capacitor connected in parallel with the first cascade; a second unit including at least a second cascade of LEDs and a second storage capacitor connected in parallel with the second cascade; wherein the second unit includes a diode coupled in series with the parallel circuit including the second cascade; wherein the electronic ballast includes: a current controller with an actual value input and a setpoint value input, a setpoint value presetting apparatus for the current through the cascades, wherein the setpoint value presetting apparatus is designed to provide a setpoint value at the setpoint value input which is proportional to the voltage at the output of the rectifier; a first actuating element; wherein the controller includes a drive output coupled to the first actuating element and a second actuating element.

9 Claims, 3 Drawing Sheets

ELECTRONIC BALLAST FOR OPERATING AT LEAST ONE FIRST CASCADE OF LEDS AND ONE SECOND CASCADE OF LEDS

CROSS-REFERENCE TO RELATED APPLICATION

This application claims priority to German Patent Application Serial No. 10 2012 215 933.9, which was filed Sep. 9, 2012, and is incorporated herein by reference in its entirety.

TECHNICAL FIELD

Various embodiments relate generally to an electronic ballast for operating at least one first cascade of light emitting diodes (LEDs) and one second cascade of LEDs, including an input with a first input connection and a second input connection for coupling to an AC supply voltage, a rectifier, which is coupled to the first input connection and the second input connection, wherein the rectifier has an output with a first output connection and a second output connection, a first unit, which includes the first cascade of LEDs and a first storage capacitor, which is connected in parallel with the first cascade of LEDs, at least one second unit, which includes at least the second cascade of LEDs and a second storage capacitor, which is connected in parallel with the second cascade of LEDs, wherein the first unit is coupled to the first output connection, and the at least one second unit is coupled in series with the first unit, to be precise on the side of the first unit which is not coupled to the first output connection, wherein the at least one second unit also includes a diode, which is coupled in series with the parallel circuit including the second cascade of LEDs and the second storage capacitor, to be precise on the side which faces the first unit.

BACKGROUND

In order to be able to operate LEDs directly on the mains, either a voltage conversion is necessary or the respective cascades of LEDs need to have a forward voltage which is in the region of the supply voltage. In this case, the last-mentioned case will be considered. Until now there have been two variants in this respect in addition to controllers switched at high frequency: firstly the LEDs are operated directly on the mains with a series resistor (so-called AC LEDs). Secondly, the LEDs are supplied with power via an in-phase controller, wherein the rectified voltage is smoothed in advance by a capacitor. In the first-mentioned variant, there are the disadvantages that the LEDs flicker at double the mains frequency or the LEDs are only on for less than half the time. Unfortunately, the second-mentioned variant is also disadvantageous since the absorption currents of the capacitors are very high in comparison with the operating current. Furthermore, the capacitors and rectifiers are overloaded during switchon since the switchon time at the mains is not defined. Finally, the power loss in the controller is undesirably high in the case of a design for the total mains tolerances.

It is known from the prior art to prevent flicker by using energy-storing components or by producing brightness modulations which are no longer visible to the eye.

Although the known electronic ballasts largely eliminate the problem of flicker, the electromagnetic interference produced in the process is undesirably high. If this is eliminated by EMC filters, additional costs are incurred. If this interference is not eliminated, the corresponding electronic ballasts are not suitable for certain applications.

SUMMARY

An electronic ballast may include: a rectifier; a first unit including a first cascade of LEDs and a first storage capacitor connected in parallel with the first cascade; a second unit including at least a second cascade of LEDs and a second storage capacitor connected in parallel with the second cascade; wherein the second unit includes a diode coupled in series with the parallel circuit including the second cascade; wherein the electronic ballast includes: a current controller with an actual value input and a setpoint value input, a setpoint value presetting apparatus for the current through the cascades, wherein the setpoint value presetting apparatus is designed to provide a setpoint value at the setpoint value input which is proportional to the voltage at the output of the rectifier; a first actuating element; wherein the controller includes a drive output coupled to the first actuating element and a second actuating element.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
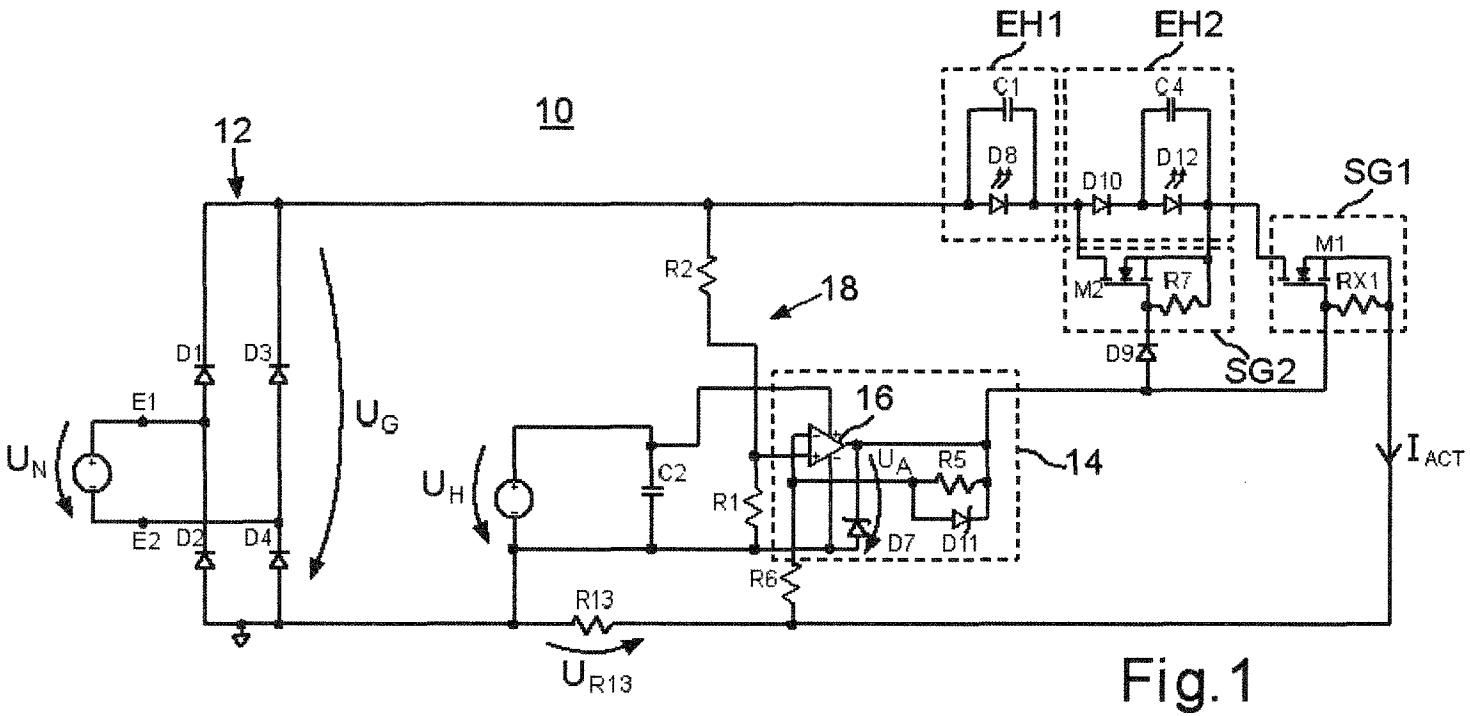
FIG. 1 shows a schematic illustration of a first embodiment of an electronic ballast.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments develop an electronic ballast mentioned at the outset in such a way that, firstly, the light emitted by the LEDs flickers as little as possible and that, secondly, as little EMC interference is caused as possible.

Various embodiments are based on the knowledge that the above object can be achieved if there is a soft switchover between the individual light emitting diode (LED) cascades. This takes place in accordance with the invention by virtue of the fact that the switchover takes place by means of transistors, wherein the switchover thresholds are predetermined in current-dependent fashion. For this purpose, a current controller with an actual value input for the current through the cascades of LEDs and a setpoint value input is provided. A setpoint value presetting apparatus for the current through the cascades of LEDs is designed to provide a setpoint value at the setpoint value input which is proportional to the voltage at the output of the rectifier. A first actuating element is coupled in series with the at least one second unit, to be precise on that side of the at least one second unit which is remote from the first unit. The at least one second unit includes a second actuating element, which is connected in parallel with the series circuit including the diode and the parallel circuit including the second cascade of LEDs and the second storage capacitor. The current controller has a drive output, which is coupled to the first actuating element and the at least one second actuating element.

By virtue of this basic principle, the switching threshold is automatically matched to the forward voltages of the LED cascades since the switchover threshold is current-dependent. Soft switchover is enabled. This principle enables current-limited charging of the storage capacitors. In the charge phase the current flows through the LEDs in the respective cascade and into the storage capacitor of the respective unit. In the discharge phase, the charge is directed from the respective storage capacitor into the respective cascade of LEDs without any current limitation. In this case, current limitation is not required since it results from the peak current in the respective preceding charge phase which is current-limited. The at least one second unit can be bypassed via an actuating element, wherein the bypass is decoupled via the diode acting as switch.

In various embodiments, a diode is coupled between the drive output and the at least one second actuating element. This ensures that the voltage present at the control input of the first actuating element is greater than the corresponding voltage which is present at the control input of the at least one second actuating element. If a plurality of second units is connected in series, this measure ensures that the voltage used for control is lower the further the respective second unit is arranged in the series circuit from the first unit. In this way, operation of the respective actuating elements depending on the instantaneous mains voltage is enabled. Thus, power factors of more than 0.9 can be achieved. In various embodiments, a power factor of 0.94 could be achieved in the case of an electronic ballast with a single second unit, and in various embodiments with two second units, a power factor of 0.99 could be achieved. The efficiency was over 85% even in the embodiment implemented with a single second unit.

Various embodiments are characterized by the fact that the setpoint value presetting apparatus includes a voltage divider, which is coupled between the first output connection and the second output connection of the rectifier, wherein the tap of the voltage divider is coupled to the setpoint value input of the current controller. In this way, a setpoint value which is proportional to the instantaneous value of the AC supply voltage can be provided in a particularly simple manner. In various embodiments, matching to the desired input level of the current controller can thus be achieved.

In various embodiments, the first actuating element and the at least one second actuating element are designed to be operated in the on state, in the off state or in particular in the linear range. This ensures that the actuating elements do not undergo hard switching, but the switching transitions are soft. This may result in particularly little mains interference. The residual current ripple is low and the flicker output by the circuit is likewise low. Since the switching can be achieved without the use of transformers or inductances, the component complexity involved is minimal. Such an electronic ballast is moreover dimmable, in principle. It is insensitive to different mains frequencies and mains voltage fluctuations. Furthermore, the residual ripple and the LED power are easily sealable.

In various embodiments, the electronic ballast further includes a shunt resistor, which is coupled between that connection of the first actuating element which is remote from the at least one second unit and the second output connection of the rectifier, wherein the voltage drop across the shunt resistor is coupled to the actual value input of the current controller. In this way, an actual value of the current flowing through the cascades of LEDs can be provided for closed-loop control in a particularly simple manner.

In various embodiments, each actuating element includes a transistor with a control electrode, a reference electrode and a working electrode, wherein the respective control electrode is coupled to the drive output of the current controller, wherein in each case at least one ohmic resistor is coupled between the respective control electrode and the respective reference electrode. The respective ohmic resistor in this case ensures discharge of the control electrode, for example of the gate in the case of the implementation of the transistor as a metal oxide semiconductor field effect transistor (MOSFET).

In various embodiments, the current controller includes an operational amplifier with an inverting input, which represents the actual value input, a non-inverting input, which represents the setpoint value input, and an output, which represents the drive output, wherein the parallel circuit including a Zener diode and an ohmic resistor is coupled between the drive output and the inverting input. By virtue of this measure, the voltage at the drive output of the operational amplifier is limited to a predeterminable value. As a result, latch-up effects can be effectively prevented. In other words, this measure ensures that, on oscillation, no overshoots in the current are produced as a result of the actuating elements, but said actuating elements can be driven very quickly again in their linear range. This makes a significant contribution to the reduction of EMC interference.

Finally, the operational amplifier includes a positive supply input and a negative supply input, wherein a Zener diode is coupled between the drive output and the negative supply input. This Zener diode acts as output protection circuitry for the operational amplifier.

FIG. 1 shows a schematic illustration of a first embodiment of an electronic ballast 10. Said electronic ballast has an input with a first and a second input connection E1, E2, which is coupled to an AC supply voltage $U_N$, e.g. a mains voltage. The input of a rectifier 12, which includes the diodes D1 to D4, is coupled to the input connections E1, E2. A rectified AC voltage $U_G$ is provided at the output of the rectifier 12.

The circuit arrangement includes a first cascade D8 of LEDs, which includes 66 LEDs in the embodiment. The cascade D8 of LEDs is connected in parallel with a storage capacitor C1. The parallel circuit is referred to below as first unit EH1. This is adjoined by a second unit EH2, which includes the parallel circuit including a second cascade D12 and a storage capacitor C4, wherein the LED cascade D12 has 22 LEDs in the embodiment. A diode D10 is coupled in series with this parallel circuit including the storage capacitor C4 and the LED cascade D12. The diode D10 is used for decoupling in order that there is no current flowing via the MOSFET M2 in the discharge phase of the capacitor C4, but only a current flowing via the LED chain D12; see the embodiments below in this regard. A first actuating element SG1 is coupled in series with the units EH1, EH2, said first actuating element including a MOSFET M1 with an ohmic resistor RX1 coupled between the gate and source connections of said MOSFET. A second actuating element SG2 is coupled in parallel with the second unit EH2. Said second actuating element includes a MOSFET M2 with an ohmic resistor R7 coupled between the gate and source connections of said MOSFET.

The electronic ballast 10 may further include a current controller 14 with an operational amplifier 16, which has an inverting input and a noninverting input and an output, a positive supply input and a negative supply input. The output of the operational amplifier 16 is coupled directly to the gate of the MOSFET M1 of the first actuating element SG1 and via a diode D9 to the gate of the MOSFET M2 of the second actuating element SG2. The positive supply input and the negative supply input are coupled to an auxiliary voltage source $U_H$, wherein the auxiliary voltage source $U_H$ is connected in parallel with a capacitor C2 for stabilization purposes. The auxiliary voltage $U_H$ can be generated from the voltage $U_G$ by a unit (not illustrated), for example.

In order to preset a setpoint value $I_{SET}$ for the current $I_{ACT}$ through the cascades of LEDs, a setpoint value presetting apparatus 18 is provided which includes a voltage divider, which is coupled between the first and the second output connections of the rectifier 12. The tap of the voltage divider 18 is coupled to the noninverting input of the operational amplifier 16. In order to measure the actual value $I_{ACT}$ of the current through the cascades of LEDs, a shunt resistor R13 is provided, wherein the voltage drop $U_{R13}$ across said shunt resistor during operation is coupled via an ohmic protective resistor R6 to the inverting input of the operational amplifier 16.

Figure 2:
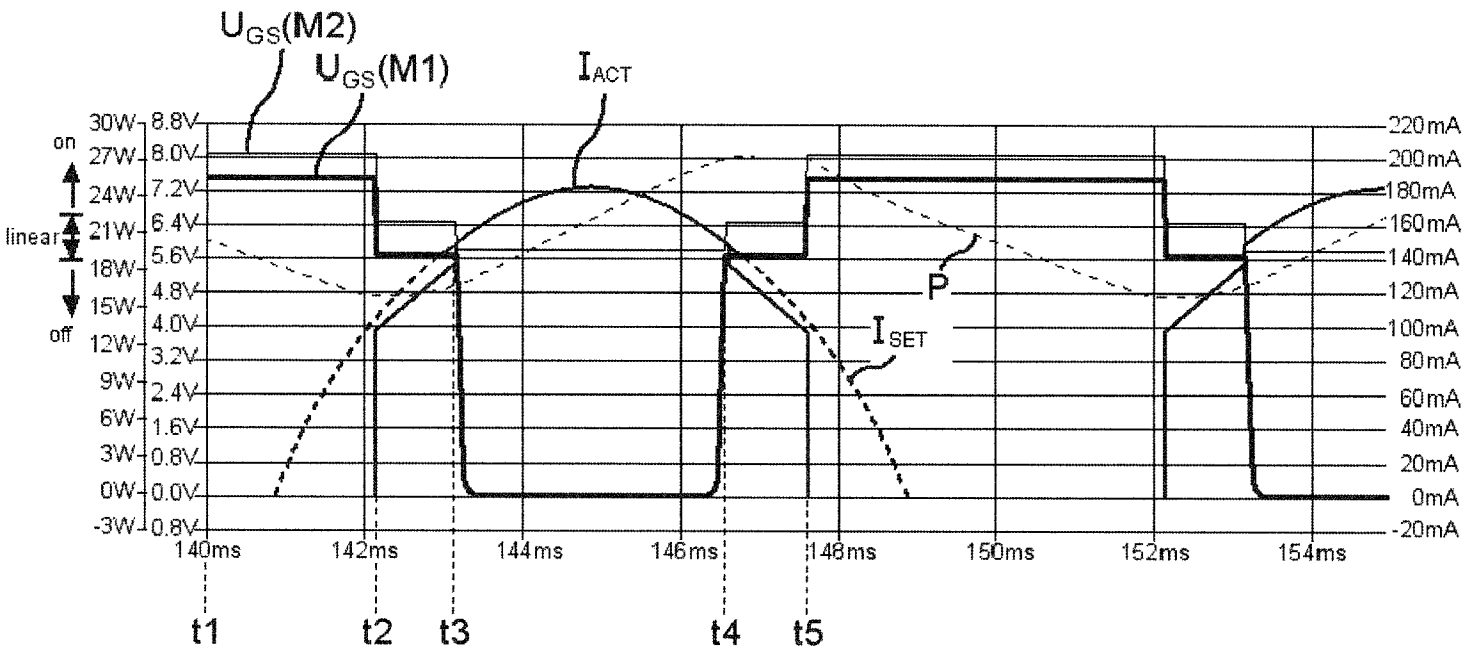
FIG. 2 shows a schematic illustration of the time profile of different signals of the embodiment illustrated in FIG. 1.

In order to clarify the mode of operation, reference is also made to FIG. 2, which shows the time profile of different signals in FIG. 1. The figure shows the time profile of the actual value $I_{ACT}$ and the setpoint value $I_{SET}$ of the current through the cascades of LEDs and the time profile of the gate-source voltages $U_{GS}$ of the MOSFET M1 and $U_{GS}$ of the MOSFET M2. Furthermore, the time profile of the power P consumed by the LEDs is shown.

When the electronic ballast is switched on, the capacitors C1 and C4 are initially empty. During the first half-cycle of the AC supply voltage $U_N$, the capacitors C1, C4 are charged with current limitation. This charge current is limited by the current controller 14. The current setpoint value $I_{SET}$ is predetermined by means of the voltage divider including R1 and R2, with the result that the setpoint value therefore follows the semisinusoidal rectified mains voltage $U_G$. The current controller 14 then increases its output voltage $U_A$ until there is the same voltage drop across the shunt resistor R13 as is present at the noninverting input of the operational amplifier 16, i.e. the potential at the tap of the voltage divider R1, R2.

In the settled state, the time profile is then dependent on the instantaneous mains voltage $U_N$, as follows:

Range t1 to t2: until the instantaneous value of the AC supply voltage reaches the sum of the forward voltages of the LED cascade D8, the two MOSFETs M1, M2 are on since, initially, no actual current $I_{ACT}$ can flow as a result of the lack of a sufficient AC supply voltage. The voltage $U_A$ at the output of the operational amplifier 16 is therefore stepped up. If, at time t2, the threshold voltage is exceeded in the rising mains half-cycle, the MOSFET M1 transfers to linear operation. The gate-source voltage $U_{GS}$ of the MOSFET M2 continues to be so high that the MOSFET M2 is operated in the on state. At time t3, the MOSFET M1 transfers to the off-state operation since, after this time, the AC supply voltage is high enough for the second unit EH2 to be able to draw energy. Correspondingly, the output voltage $U_A$ at the operational amplifier 16 is reduced.

As the AC supply voltage continues to increase, finally the MOSFET M1 is turned off completely at time t3 and M2 acts as a linear controller. If the instantaneous AC supply voltage falls again, initially M2 will be completely on again (time t4) and M1 again operates as controller actuating element in the linear range. Finally, M1 is also turned on again (see time t5), with the result that the cascade D12 is then supplied via the capacitor C4. As the instantaneous value for the AC supply voltage $U_N$ falls further, it is no longer possible for any current to flow through the unit EH1, in which case the LED cascade D8 draws its energy from the capacitor C1.

This is repeated cyclically in synchronism with double the frequency of the AC supply voltage $U_N$, i.e. every 10 ms in the case of an AC supply voltage of 50 Hz.

Owing to the functional principle illustrated, a time-distributed current consumption results, by means of which very good power factors and extremely low levels of EMC interference can be achieved. The diode D9 ensures that the gate-source voltage of the MOSFET M1 is always greater than the gate-source voltage of the MOSFET M2. To this extent, the MOSFET M2 is on for longer periods than the MOSFET M1. As is also apparent from the time profile shown in FIG. 2, at least one of the two MOSFETs M1, M2 is on or is operated linearly. As a result, transition peaks at the time of switching can be avoided reliably, with the result that no EMC filters are required. By virtue of the switching times being fixed dynamically, these switching times do not first need to be found as in the prior art. Instead, the switching thresholds are automatically provided by virtue of the current being impressed.

The auxiliary voltage $U_H$ is e.g. derived from the AC supply voltage $U_N$ using an in-phase controller. The capacitor C2 is used for providing an auxiliary supply voltage at the times at which the AC mains supply voltage is lower than a predeterminable threshold value, for example 12V. The Zener diode D7 represents output protection circuitry for the operational amplifier 16.

The Zener diode D11 limits the output voltage of the operational amplifier 16 in order to effectively prevent latch-up effects. The operational amplifier 16 therefore operates at time t2 in the linear range quickly again, for example. Moreover, overshoots during oscillation are prevented. For example, without this measure the output voltage of the operational amplifier 16 would rise to 12V between t1 and t2 if the auxiliary voltage supply $U_H$ provides a voltage of 12V. By suitable dimensioning of the Zener diode D11, the output voltage can be limited to approximately 7V. The resistors R7 and RX1 serve the purpose of discharging the gates of the MOSFETs M1 and M2, respectively.

A dimensioning for the forward voltages of the LED cascades in accordance with various embodiments may result in the following way: if Umin represents the minimum rms value of the AC supply voltage, VCC=Umin·1.41 represents the peak value for the AC supply voltage, the forward voltage on rated current of the entire LED cascade is Ufges, the forward voltage of the individual LEDs is Uf and the number of LEDs is equal to N, current must be able to flow into the relatively long chain at least in 5 ms of the 10 ms of mains frequency in order to be able to maintain power factors of more than 0.9 and to adhere to relevant standards in respect of harmonics. In other words, the maximum sum of the LED forward voltages needs to be lower than 0.5 SQR3 of the peak voltage of the AC supply voltage. The following may result:

$$Ufges = Uf \cdot N < 0.5 \cdot SQR3 \cdot SQR2 \cdot 230V,$$

where SQR3 represents the square root of 3 and SQR2 represents the square root of 2.

On a mains voltage of 230V, a favorable range of 180V<Ufges<280V thus results.

Owing to the required voltage tolerances, a range of 180 to 220V is expedient. In various embodiments, therefore, the LED cascade D8 has been designed with 66 LEDs. This corresponds to a voltage of approximately 3.0V·66 LEDs=198V. The relatively short LED cascade D12 is then designed favorably such that a total voltage of 250 to 300V results. In various embodiments, 22 LEDs were selected for D12. This then results in a total chain length of 88 LEDs, which approximately results in a total forward voltage of 264V. The MOSFET M1 must be designed for the maximum rectified AC supply voltage and the peak current and, for a short period of time, for the rated power resulting from this product. The transistor can be a bipolar transistor or, as illustrated, a MOSFET. Transistor M2 only needs to cope with the differential voltage at the LED cascade D12.

The storage capacitors should favorably have a capacitance in the range of between 100 and 1000 μF per ampere of the LED current $I_{ACT}$, i.e. a capacitance of between 2 μF and 20 μF at an actual current of 20 mA. High values minimize the residual ripple, small values minimize the switchon time. The capacitors C1 and C4 may therefore be simple electrolyte capacitors since they are charged and discharged in a controlled manner. Their high-frequency response is irrelevant here.

The rectifier only needs to be designed for the defined peak current and the AC supply voltage.

The respective LED cascades may also be divided into a plurality of taps.

Figure 3:
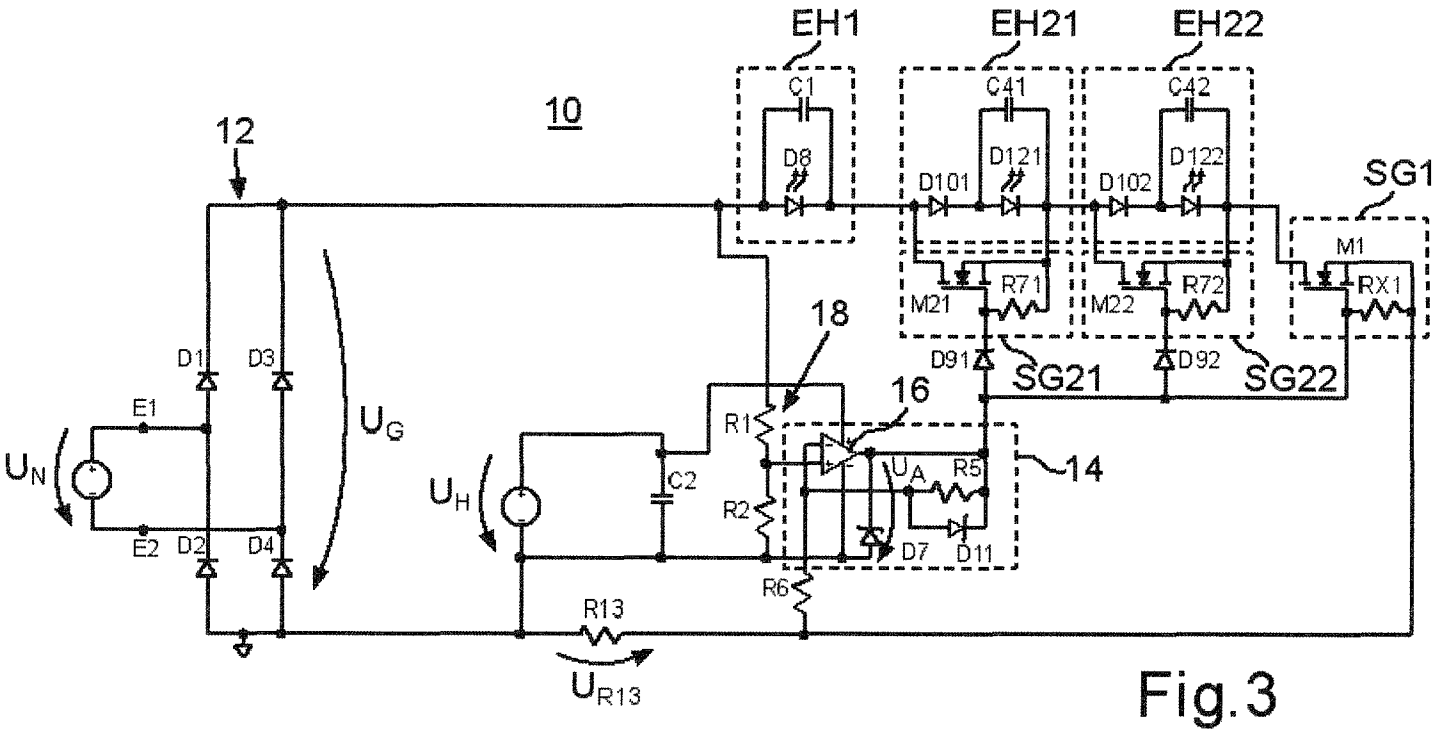
FIG. 3 shows a schematic illustration of a second embodiment of an electronic ballast.

The number of second units EH2 may be varied in order to obtain even better mains properties. In this context, FIG. 3 shows an embodiment with two second units EH21 and EH22 and corresponding actuating elements SG21 and SG22. The reference symbols introduced with reference to FIG. 1 are used for identical and functionally identical reference symbols. It is of course also possible for other units EH2 to be provided, with corresponding actuating elements SG2 connected in parallel therewith. In principle, the actuating element SG2 arranged next to the first unit EH1 always begins to operate in the linear range, i.e. it changes over gradually from operation in the on state to operation in the off state. If said actuating element then begins to be turned off, the next actuating element SG2 is turned on. For the exemplary embodiment illustrated in FIG. 3, therefore, the time profile would appear approximately as follows:

| | Range 1 | Range 2 | Range 3 | Range 4 |
|---|---|---|---|---|
| SG1 | on | linear | off | off |
| SG21 | on | on | linear | off |
| SG22 | on | on | on | linear |

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An electronic ballast for operating at least one first cascade of light emitting diodes and one second cascade of light emitting diodes, comprising:

an input with a first input connection and a second input connection for coupling to an AC supply voltage;

a rectifier, which is coupled to the first input connection and the second input connection, wherein the rectifier has an output with a first output connection and a second output connection;

a first unit, which comprises the first cascade of light emitting diodes and a first storage capacitor, which is connected in parallel with the first cascade of light emitting diodes;

at least one second unit, which comprises at least the second cascade of light emitting diodes and a second storage capacitor, which is connected in parallel with the second cascade of light emitting diodes;

wherein the first unit is coupled to the first output connection, and the at least one second unit is coupled in series with the first unit, to be precise on the side of the first unit which is not coupled to the first output connection;

wherein the at least one second unit also comprises a diode, which is coupled in series with the parallel circuit comprising the second cascade of light emitting diodes and the second storage capacitor, to be precise on the side which faces the first unit;

wherein the electronic ballast further comprises:

a current controller with an actual value input for the current through the cascades of light emitting diodes and a setpoint value input, a setpoint value presetting apparatus for the current through the cascades of light emitting diodes, wherein the setpoint value presetting apparatus is designed to provide a setpoint value at the setpoint value input which is proportional to the voltage at the output of the rectifier;

a first actuating element, which is coupled in series with the at least one second unit, to be precise on that side of the at least one second unit which is remote from the first unit;

wherein the at least one second unit comprises a second actuating element, which is connected in parallel with the series circuit comprising the diode and the parallel circuit comprising the second cascade of light emitting diodes and the second storage capacitor, wherein the current controller comprises a drive output, wherein the drive output is coupled to the first actuating element and the at least one second actuating element wherein the current controller comprises an operational amplifier with an inverting input, which represents the actual value input, a non-inverting input, which represents the setpoint value input, and an output, which represents the drive output, wherein a parallel circuit, comprising a first Zener diode and an ohmic resistor, is coupled between the drive output and the inverting input.

2. The electronic ballast of claim 1, wherein a diode is coupled between the drive output and the at least one second actuating element.

3. The electronic ballast of claim 1, wherein the setpoint value presetting apparatus comprises a voltage divider, which is coupled between the first output connection and the second output connection of the rectifier, wherein the tap of the voltage divider is coupled to the setpoint value input of the current controller.

4. The electronic ballast of claim 1, wherein the first actuating element and the at least one second actuating element are designed to be operated in the on state, in the off state or in the linear range.

5. The electronic ballast of claim 1, wherein the electronic ballast further comprises a shunt resistor, which is coupled between that connection of the first actuating element which is remote from the at least one second unit and the second output connection of the rectifier, wherein the voltage drop across the shunt resistor is coupled to the actual value input of the current controller.

6. The electronic ballast of claim 1, wherein each actuating element comprises a transistor with a control electrode, a reference electrode and a working electrode, wherein the respective control electrode is coupled to the drive output of the current controller, wherein in each case at least one ohmic resistor is coupled between the respective control electrode and the respective reference electrode.

7. The electronic ballast of claim 1, wherein the operational amplifier comprises a positive supply input and a negative supply input, wherein a second Zener diode is coupled between the drive output and the negative supply input.

8. The electronic ballast of claim 1, wherein the first Zener diode is configured to limit an output voltage of the operational amplifier.

9. The electronic ballast of claim 8, wherein the output voltage is substantially limited to 7 V.

* * * * *